United States Patent [19]

Wright et al.

[11] 3,980,360

[45] Sept. 14, 1976

[54] HANGABLE HOLDER FOR STATIONERY MATERIALS

[75] Inventors: David M. Wright, Shrewsbury; Donald B. McCallum, Douglas, both of Mass.

[73] Assignee: Barry Wright Corporation, Watertown, Mass.

[22] Filed: Apr. 11, 1975

[21] Appl. No.: 567,137

[52] U.S. Cl. ..... 312/184; 402/4; 402/38

[51] Int. Cl.[2] ..... A47B 63/00

[58] Field of Search ..... 312/184; 402/4, 38

[56] References Cited

UNITED STATES PATENTS

| | | | |
|---|---|---|---|
| 766,364 | 8/1904 | Lawson | 402/4 |
| 2,483,046 | 9/1949 | Heckert | 312/184 |
| 3,540,832 | 11/1970 | Morris | 402/4 |
| 3,628,877 | 12/1971 | Barnes, Jr. | 402/4 |
| 3,865,445 | 2/1975 | Dean et al. | 312/184 |
| 3,884,586 | 5/1975 | Michaelis et al. | 402/38 |

FOREIGN PATENTS OR APPLICATIONS

| | | | |
|---|---|---|---|
| 547,860 | 6/1956 | Belgium | 312/184 |
| 1,207,338 | 12/1965 | Germany | 312/184 |
| 1,042,535 | 11/1958 | Germany | 312/184 |
| 630,877 | 12/1961 | Italy | 312/184 |
| 203,966 | 7/1939 | Switzerland | 312/184 |

*Primary Examiner*—Paul R. Gilliam
*Assistant Examiner*—Victor N. Sakran
*Attorney, Agent, or Firm*—Milton E. Gilbert

[57] ABSTRACT

A novel one-piece holder is provided for binding a multi-leaf computer printout and mounting the same in a suspension-filing and/or storing system.

17 Claims, 9 Drawing Figures

HANGABLE HOLDER FOR STATIONERY MATERIALS

This invention relates to suspension filing systems for documents and more particularly to means for binding and filing papers, prints and other sheet materials which are too limp to remain flat when stood on edge in a cabinet or on a shelf.

In recent years substantial consideration has been given to providing means for filing and storing computer printout sheets. The latter are usually folded accordian-wise and it is not uncommon for a single computer printout to number a hundred or more pages or folds. Because many such printouts are required to be preserved and referred to frequently for information, it is desirable to provide means for binding a computer printout so that it can be filed and stored in a safe and convenient manner and readily available for review.

Therefore, the primary object of this invention is to provide a novel means for filing and storing computer printouts by a suspension system.

Another object is to provide a novel holder means for filing and storing burst or unburst computer printouts in accordance with the conventional hanging folder method or by a center hook suspension arrangement.

A more specific object is to provide a novel device for binding and suspending computer printout.

Still another object is to provide a novel hanger bar arrangement for filing and storing of computer printout.

A further object is to provide novel means of the character described for filing and storing documents such as letters, ledger sheets, drawings, computer printout, catalog pages and the like.

A further specific object is to provide an improved holder for suspending an article of stationary from one or more suspension bars, the holder having relatively simple means for releasably binding the article thereto.

Another object is to provide a library unit having one or more novel suspension bars designed to suspend document holders of the type having off center suspension holes so that the document holders will be held against tilting.

These objects are achieved by providing a holder which is of general channel form in cross-sectional so that a computer printout or other article of stationary may be inserted into the channel, and at least a pair of retaining pins carried by the holder for releasably securing or binding the computer printout or other article of stationery to the holder. The holder is designed to handle different sizes and amounts of computer printout; is adapted for suspension from a pair of end rails or from a single center rail; and offers the capability of quick attachment and detachment of contents. The holder is usable with a library unit having a novel suspension bar for supporting the holder by its center hook.

Other features and many of the advantages of the invention are set forth in or rendered obvious by the following detailed specification and the accompanying drawings wherein.

In the drawings, like numerals refer to like parts.

Figure 1:
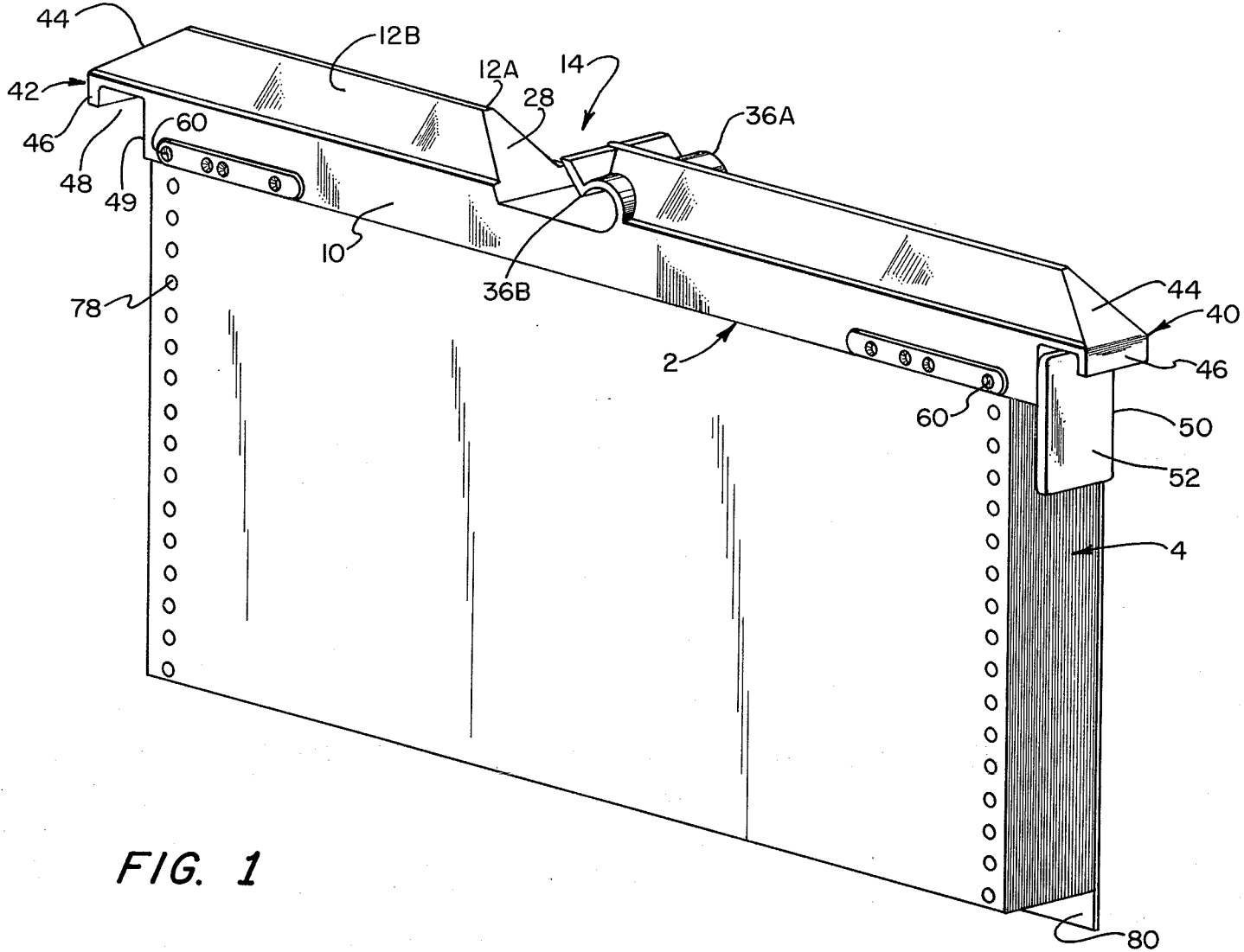
FIG. 1 is a perspective view showing a computer printout mounted to a holder which constitutes a preferred form of the invention.

Turning now to FIGS. 1–6, there is shown a cartridge-type holder 2 for binding a computer printout 4 and suspending the same in a suspension filing system either of the type having a single center suspension rail or the type having a pair of parallel end suspension rails. The holder is considered to be cartridge-type since it has a cavity in the form of a channel for receiving a portion of the computer printout or other document or stationery item which is to be bound.

The holder 2 is a one-piece unit molded of a suitable plastic material such as polypropylene and provided with at least a pair of retaining pins 6 (hereinafter described in greater detail) for releasably binding the computer printout or other stationery article. The holder 2 is of general channel form in cross-section with the channel being inverted when the holder is in use to store its contents in a suspension filing system. More particularly, the holder as viewed in cross-section comprises mutually parallel front and back limbs 8 and 10 and a web which may be in the form of a semi-circular hollow arch but preferably is a hollow generally triangular section consisting of oppositely inclined side walls 12A and 12B that are molded integral with limbs 8 and 10 respectively. The web section of the holder is interrupted by a hook section 14.

Figure 2:
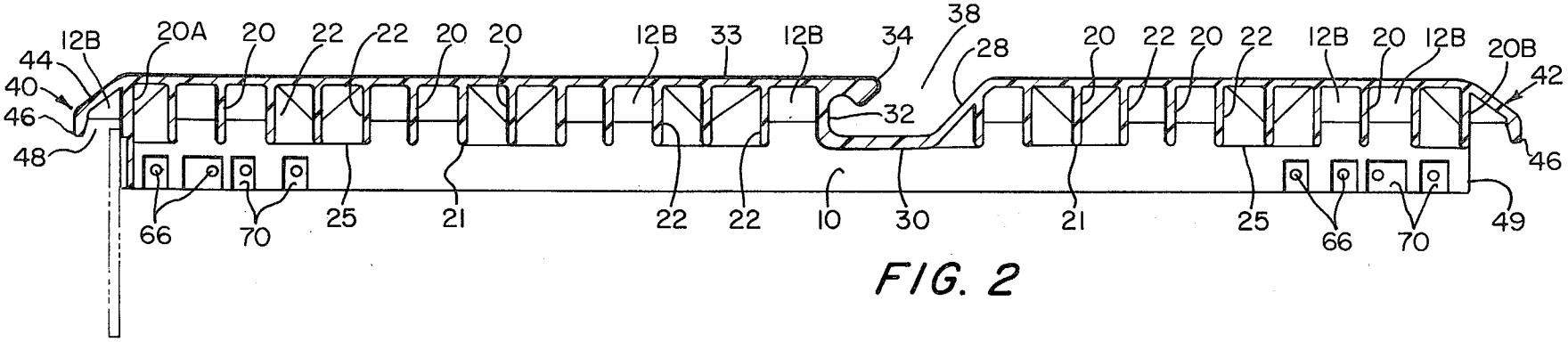
FIG. 2 is a longitudinal sectional view of the same holder taken along line 2—2 of FIG. 3.

The holder is reinforced by a plurality of parallel, longitudinally spaced struts 20 which extend at a right angle to limbs 8 and 10 and an additional plurality of struts 22 which extend at an acute angle, preferably 45° as shown, to struts 20 and limbs 8 and 10. The struts 20 and 22 are integral with the side walls 12A and 12B of the web section and also with limbs 8 and 10. However, the vertical dimension of struts 20 is substantially less than the corresponding overall vertical dimension of the holder and preferably (as shown in FIG. 2) the free edges 21 of struts 20 reside in a common plane and are all spaced the same distance from the apex of the web section. While the struts 22 may have a different vertical dimension, it is preferred that their free edges 25 be located co-planar with the corresponding edges 21 of struts 20.

The hook section 14 is located adjacent but slightly to one side of the midpoint of the holder and comprises three plate portions 28, 30 and 32 which extend at right angles to limbs 8 and 10. Plate portion 28 extends at an inclined angle, preferably at 45° as shown, to the flat upper edge 33 of the holder's web section and forms an integral end wall for one part of the web section.

Plate 30 extends parallel to the upper edge 33 of the web section and connects plates 28 with plate 32. The latter extends at about a right angle to plate 30 and forms an integral end wall for the other part of the web section. At its upper end, plate 32 is formed with a hook 34. Web sections 36A and B (FIG. 1) are provided at opposite sides of hook 34 and plate 32 for the purpose of strengthening hook 34 and also to restrain the holder from tilting about a vertical axis when hook 34 is engaged with a suspension rail. A relatively large opening 38 is provided between the end of hook 34 and inclined plate 28 so as to facilitate engagement of hook 34 with a suspension rail. Also, the upper surface of hook 34 is an extension of the upper edge 33 of the adjacent web section.

Figure 3:
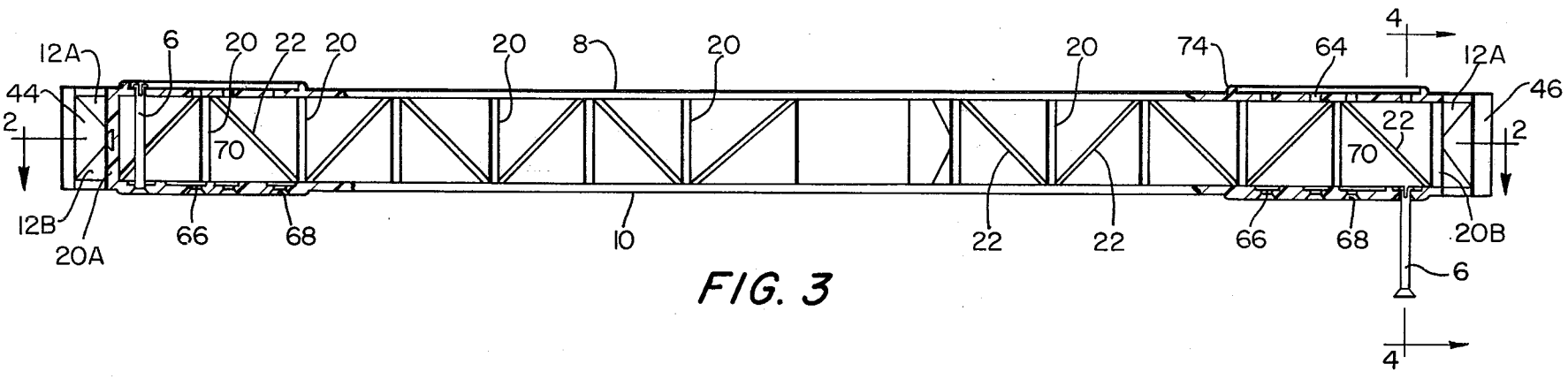
FIG. 3 is a bottom view of the same holder.
Figure 6:
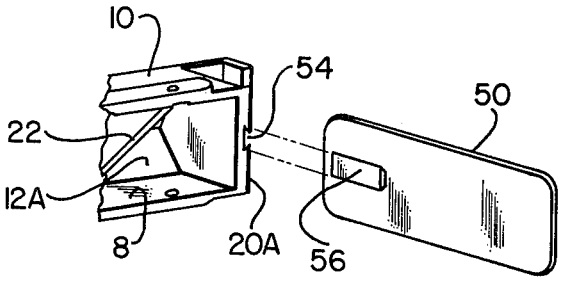
FIG. 6 is a fragmentary perspective view on a scale comparable to that of FIGS. 2 and 3 showing the label holder in exploded relation to the holder.

Referring now to FIGS. 1–3, the opposite ends of the holder are formed with identical end hook sections identified generally as 40 and 42 which comprise extensions of the side walls 12A and B of its web section, slanted end walls 44 and a flange or lip 46 formed integral with the bottom edge of each end wall. As seen best in FIG. 2, at each end of the holder the side or end edges 49 of limbs 8 and 10 are flush with and joined by an end strut 20, and the flanges 46 are spaced from those end struts so as to form recesses 48 to accommodate side suspension bars or rails (not shown). As seen in FIGS. 1–3 and 6, the lower edge of the end strut 20B associated with end hook 42 is flush with the corresponding lower edges of all of the other struts 20 except the end strut 20A associated with end hook 40. Each strut 20A is made long enough so that its lower edge is substantially flush with the lower edges of limbs 8 and 10. Thus, strut 20A serves as an end wall since it effectively closes off one end of the channel formed between limbs 8 and 10. In this connection it is to be noted also that the effective depth of the aforesaid channel is the distance between the lower edges of limbs 8 and 10 and the lower edges of struts 20. Strut 20A also serves as a mounting means for a label holder 50 (FIGS. 1 and 6). The latter is a flat plate with a front surface 52 which is made large enough to act as a substrate for a conventional adhesive backed label (not shown) that carries indicia identifying the data carried by the computer printout 4. Label holder 50 is attached to strut 20A by a dovetail type connection. Accordingly, as seen in FIGS. 3 and 6, strut 20A is formed with a dovetail groove 54 and holder 50 is formed with a mating dovetail 56 on its rear side. The latter and groove 54 are sized to make a tight sliding fit so that the label holder will not fall off of its own weight but instead can be removed only by exerting a suitable pulling force.

Since the end strut 20B is flush with all of the other struts except strut 20A and thus has its lower edge terminate short of the lower edges of limbs 8 and 10, the channel 58 formed between the limbs is open at that end of the holder having hook 42 but is closed at the other end by strut 20A. Accordingly, a multi-fold computer printout as shown at 4 can be inserted between limbs 8 and 10 via the open end of the channel 58. This is advantageous where the thickness of the folded computer printout is approximately equal to the width of channel 58, since in such case it is easier to insert the printout into one end of the channel and then slide it lengthwise along the channel then it is to insert the printout edgewise into the entire channel at one time. As indicated previously, the computer printout is bound in place by stiff yet resilient retainer pins 62 which extend through holes in the side edges of that printout. The pins 6 may be made of metal but preferably are made of a plastic of suitable resiliency and strength, e.g., polypropylene. One end of each pin is formed with a frusto-conical head 60. The other end of each pin is bifurcated by a diametric slot so as to form two opposed end sections 61 each having a flange or lip 62 formed along its circularly curved edge. The leading and trailing sides of each lip 62 are tapered or bevelled as shown best in FIG. 5A so as to facilitate attachment and detachment of the pin as hereinafter described.

Figure 4:
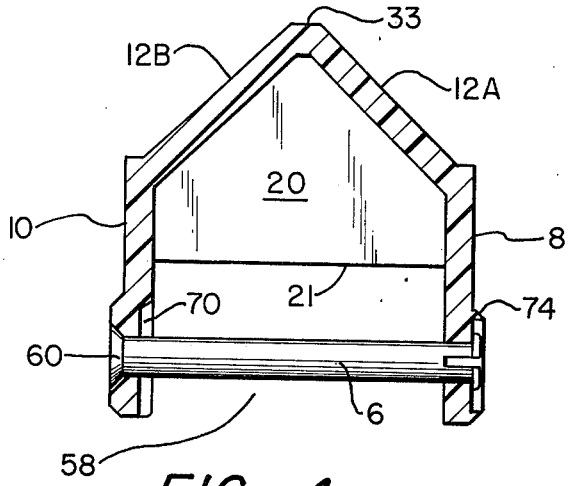
FIG. 4 is an enlarged cross-sectional view taken along line 4—4 of FIG. 3 showing a retainer pin in sheet-retaining position.
Figure 5:
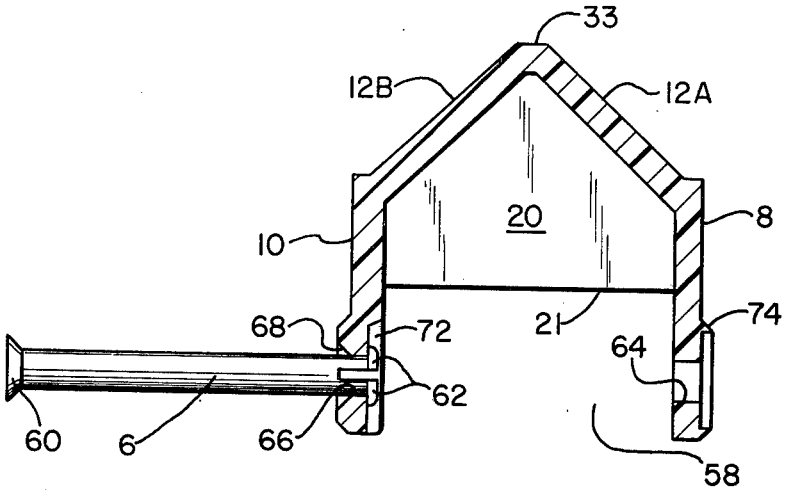
FIG. 5 is the same as FIG. 4 except that the retainer pin is in sheet-releasing position.
Figure 5A:
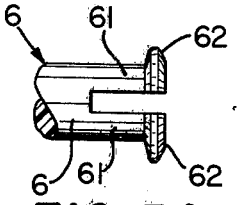
FIG. 5A is an enlarged longitudinal section of the split end of one of the retainer pins.

As seen in FIGS. 1–6 and 8, each end of limb 8 is provided with at least one and preferably several holes 64 for accommodating a pin 6 and each end of limb 10 is provided with a corresponding number of holes 66 which are aligned with holes 64. Each of the holes 64 and 66 is just large enough to slidably accommodate the shank of a pin 6 but not large enough to pass the pin head 60 or the ribs 62 unless the opposed end sections 61 are bent toward one another far enough for the ribs to enter the hole. The outer end of each hole 66 is flared or countersunk as shown at 68 so as to form a seat for a pin heat 60. The inner surface of limb 10 is formed with recesses 70 around the inner ends of holes 66 with each recess being deep enough to permit a pin to be pulled out of the hole far enough so that (as shown in FIG. 5) the lips 62 will not project into channel 58. Each pin 6 has a length such that when it is disposed in a matching pair of holes 64 and 66 with its head 60 seated snugly in the countersink 68, its end lips 62 will be in engagement with or at least lie very close to the outer surface of limb 8 as shown in FIG. 4. Since the lips 62 of a pin 6 will not pass through holes 64 and 66 unless the end sections 61 are compressed radially, a snap action connection or detent like coupling is effected when a pin 6 mounted in a hole 66 is extended across channel 58 and its split end forced through the corresponding hole 64. In this connection it is to be noted that rounding the peripheral portion of lips 62, i.e. tapering or bevelling of the front and rear sides of the lips as shown in FIG. 5A, assures that a smooth camming action bending the pin sections 61 toward one enough will result when the portion of limb 8 or 10 that surrounds a hole is engaged forcefully by lips 62. Since the end sections 61 are resilient, they will spring apart again when lips 62 have passed through a hole 64 or 66. Assuming that a pin 6 has been inserted through a pair of holes 64 and 66 so that its lips 62 are interlocked with limb 8 as shown in FIG. 4, it may be removed from limb 8 by pressing a suitable tool, e.g. a blunt ended awl, against the end surfaces of its two sections 61 and forcing the pin back toward limb 10. If sufficient axial pressure is applied, the end sections 61 will yield toward one another enough to allow lips 62 to pass into and through the hole 64. The pin can then be pulled out far enough as shown in FIG. 4, so that its bifurcated end will not protrude into channel 58 and cannot interfere with insertion or removal of stationery sheet materials like a computer printout. Engagement of lips 62 with the inner surface of limb 10 as shown in FIG. 5 prevents pins 6 from falling loose from the holder. Of course, complete detachment of a pin 6 from limb 10 may be desirable and is effected merely by pulling or pushing it with enough force to cause its split ends to yield radially in the same manner as when the pin is being inserted in or removed from a hole 64.

A further feature is provision on the outer surface of limb 8 of a rib 74 in the form of a closed loop that surrounds each group of holes 64. The ribs 74 from spacers for the holder that shield the split ends of the pins 6 from being struck by or engaging an adjacent holder when a plurality of holders are hung side by side.

In the preferred mode of practicing the invention several holes 64 and 76 are provided in each end of the limbs 8 and 10 respectively in order to enable the holder to accommodate different size sheet stationery. In this connection it is to be noted that computer printout paper is available in different widths, e.g. 12, 16 and 18 inches. Each size printout paper is provided with a series of sprocket mounting holes along each edge as shown at 78 in FIG. 1, and the distance between the two rows of holes and generally the size of the holes is set according to a predetermined standard. Therefore, the spacing between each hole 64 or 66 at one end and the corresponding hole 64 or 66 at the other end of the holder is set according to the spacing of the holes 78 of a particular size computer printout paper.

While it is not essential, it also is contemplated that a stiff or flexible backing 80 made of heavy paper stock or plastic may be associated with the printout 4. While not shown, it is to be understood that backing sheet 80 also will have holes similar to holes 78 whereby it may be bound to the holder by pins 6.

As indicated earlier the holder 2 may be suspended by means of its ends hooks 40 and 42 from a pair of parallel side rails. Thus, the holder and its contents may be stored in a file drawer in the manner of a cross-sectional hanging folder. It also may be supported from a single rail by means of its hook section 14.

Figure 7:
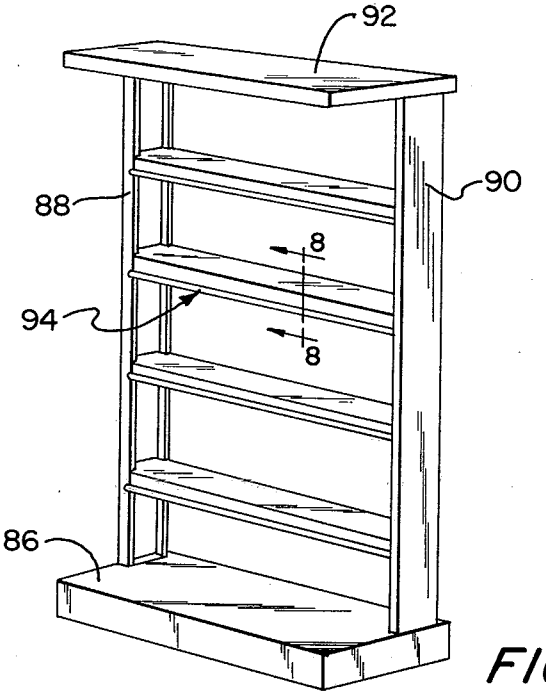
FIG. 7 is a perspective view of a library unit having novel suspension bars designed for center hook suspension of computer printout holders.

FIG. 7 illustrates a library unit 84 adapted for center hook suspension of the above-described holder. The library unit comprises a base 86, a pair of side walls 88 and 90, and a top plate 92 secured together to form a sturdy open rectangular frame. Secured to and extending between the side walls are several cross-members identified generally by the numeral 94 which are adapted to serve as suspension bars for suspending holders of the type herein described by their center hook sections 14. As shown in the enlarged scale view of FIG. 8, each cross member 94 is of open channel construction and comprises a flat web section 96, a pair of depending side sections 98 and 100 which are integral with and extend at right angles to the front and rear edges of web sections 96, and right angle, forwardly-extending flanges 102 and 104 formed integral with the bottom ends of side sections 98 and 100 respectively. The forward edge of flange 102 is rolled to form a lip or bead 106 which is sized to fit in the recess formed by hook 34 and plate 32. A depending flange 108 found integral with each end of web section 96 is provided to attach the cross-member to side walls 88 and 90.

Figure 8:
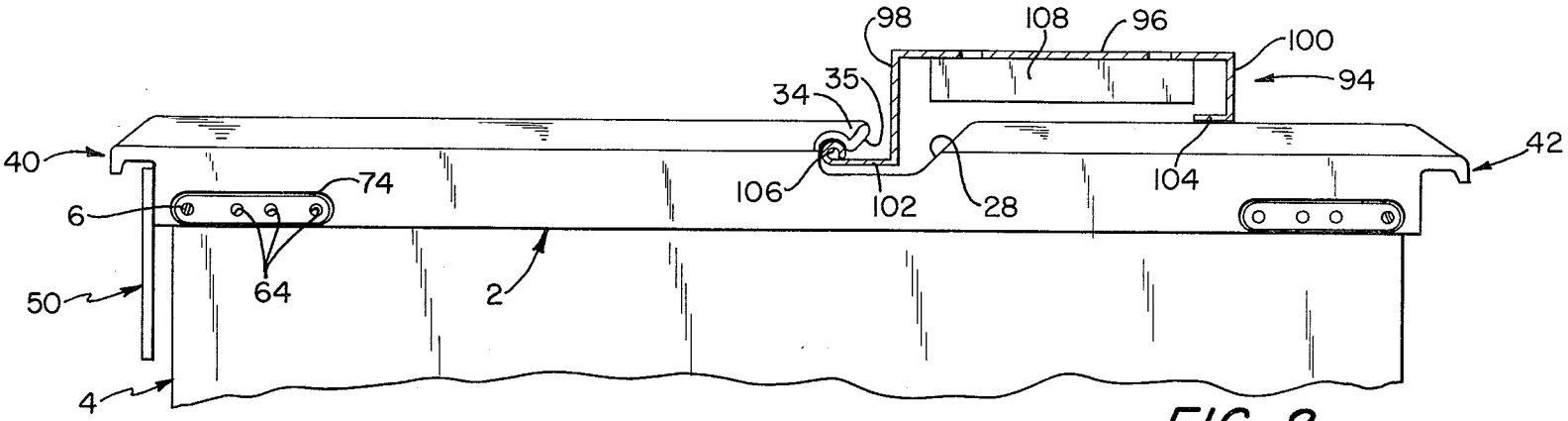
FIG. 8 is an enlarged cross-sectional view taken along line 8—8 of FIG. 7 showing how the holder of FIG. 1 is hung by its center hook from one of the novel suspension bars of the library unit.

The rear side section 100 is shorter than front side section 98 by an amount equal to the vertical distance between the flat upper edge 33 of the holder and the bottom surface of flange 102 when hook 34 is hooked over bead 106 as shown in FIG. 8. As a consequence of this difference in height between side sections 98 and 100, the upper edge 33 of the holder between hook 34 and end hook 42 will engage the underside of flange 104 when the holder is exactly horizontal or substantially so. In this connection it is to be noted that the hook 34 is located closer to end hook 42 than end hook 40, with the result that when the holder is hung from bead 106 as shown in FIG. 8, its center of gravity will be forward of bead 106 and hence will urge the holder to pivot on the bead in a direction (counterclockwise as viewed in FIG. 8) such as to keep the upper edge 33 of the holder against flange 104. The net result is that the holder and its contents will hang even. A further advantage of the invention is that the flange 102 of cross bar 94 cooperates with upper edge 33 and surfaces 28 and 30 of the holder to permit and assure quick and easy mounting and dismounting of the holder with respect to the cross-bar. For example, if a holder loaded as shown in FIG. 1 is to be stored, the custodian of the holder merely needs to point its end hook 42 at bead 106 of a cross-bar and extend the holder under the cross-bar with its upper edge 33 engaging the underside of flange 102 (this action is facilitated by first engaging the bead 106 with the sloping end surface 44 associated with hook 42). At about the same time as inclined plate 28 passes by the rear edge of flange 102, the inclined forward surface 35 of hook 34 will strike the bead and cam the holder upward so that the hook will slip over and interlock with the bead. The recess 38 of hook section 14 is made large enough to accommodate flange 102 when hook 34 is engaged with bead 106, thereby permitting the unbalanced holder to want to pivot and be held by flange 104.

In addition to the advantages hereby mentioned or rendered obvious, holders made in accordance with this invention are also characterized by low cost of manufacture, relatively high strength coupled with relatively low weight, and the ability to be packed for shipment in layers since the limbs 8 and 10 are flat and the upper side of hook 34 is flush with the upper edge 33 of the arched web section. Also the holders may be nested if pins 6 are removed.

It is to be noted also that the invention is susceptible of being practiced otherwise than as herein illustrated. Thus, for example, the pins 6 need not be bifurcated at one end but instead may be solid and provided with resilient radial tangs in place of lips 62. Also the pins 6 may be slotted so as to have three or more flexible sections in place of sections 61.

What we claim is:

1. A filing device for binding stationery materials and suspending them in a suspension filing system, said device comprising:

an elongate one-piece molded plastic holder having (a) at least one hook for suspending it from a suspension hanger bar and (b) a web section, first and second mutually spaced limbs formed integral with opposite sides of said web section and coacting therewith to form an open channel, and a plurality of struts extending across and formed integral with the web section, at least two of said struts being located at opposite ends of said holder; and at least two pins detachably carried by said holder for releasably securing at least one sheet of stationery material disposed in said channel, each of said pins extending between and being disposed in aligned holes formed in said limbs.

2. A device according to claim 1 wherein said web section is arched.

3. A device according to claim 2 wherein at least some of said struts have corresponding edges located in a common plane and determining the depth of said channel.

4. A device according to claim 2 wherein one of said struts extends between said limbs and forms an end wall closing off one end of said channel.

5. A device according to claim 4 further including a label holder removably attached to said one strut.

6. A device according to claim 5 wherein said label holder is attached to said one strut by a dovetail connection.

7. A device according to claim 1 wherein said holder has a molded hook at each end for suspending said device from a pair of parallel rails.

8. A device according to claim 7 wherein said holder comprises a third molded hook located between its ends for optionally suspending said device from a hanger to which said third hook is attached.

9. A device according to claim 1 wherein one end of each pin is oversized with respect to said holes but is compressible radially so that it can pass through said holes.

10. A device according to claim 9 wherein said one end of each pin is formed with at least two resilient end sections that are yieldable radially.

11. A device according to claim 9 wherein said one end of each pin is formed with a peripheral lip.

12. A device according to claim 8 wherein said holder has a straight upper edge and a recess in said upper edge defining at least a part of said third hook, and a suspension bar for suspending said holder by said third hook, said suspension bar comprising a channel member having a channel web section and front and rear side sections formed integral with and depending from the channel web section, first and second flanges formed integral with said front and rear side sections respectively, and a bead carried by said first flange adapted to interlock with said third hook so as to suspend said holder from said suspension bar, said third hook being located closer to one end than the other of said holder and said first flange being spaced further from said web section than said second flange, whereby when said third hook is interlocked with said bead the center of gravity of said holder will urge the holder to pivot on said bead in a direction to maintain said straight upper edge in contact with said second flange.

13. A suspension bar for suspending an elongate article holder of the type having a hook located near but to one side of its midpoint, said suspension bar comprising a channel member having a channel web section and front and rear side sections formed integral with and depending from said channel web section, first and second flanges formed integral with said front and rear side sections, and a bead carried by said first flange adapted for interlocking engagement by a hook of an article holder whereby to suspend the article holder, said first flange being spaced further from said web section than said second flange.

14. A device according to claim 1 wherein said limbs extend parallel to one another.

15. A device according to claim 1 wherein each of said pins has an enlarged head at one end and is split at its opposite end.

16. A device according to claim 8 wherein said third hook is located nearer to one of the two opposite ends of the holder and also is disposed so that it faces said one end of the holder.

17. A device according to claim 1 wherein said holder has a molded hook located between its ends for suspending said device from a hanger to which said third hook is attached.

* * * * *

UNITED STATES PATENT AND TRADEMARK OFFICE

CERTIFICATE OF CORRECTION

PATENT NO. : 3,980,360

DATED : September 14, 1976

INVENTOR(S) : David M. Wright and Donald B. McCallum

It is certified that error appears in the above-identified patent and that said Letters Patent are hereby corrected as shown below:

| | |
|---|---|
| Column 1, Line 38: | Delete word "stationary" and substitute therefor the word "stationery" |
| Column 1, Line 47: | Delete the word "cross-sectional" and substitute therefor the word "cross-section" |
| Column 1, Line 48: | Delete the word "stationary" and substitute therefor the word "stationery" |
| Column 3, Line 2: | Delete the word "plates" and substitute therefor the word "plate" |
| Column 3, Line 64: | Delete the word "then" and substitute therefor the word "than" |
| Column 4, Line 22: | Delete the word "heat" and substitute therefor the word "head" |
| Column 4, Line 68: | Delete the word "from" and substitute therefor the word "form" |
| Column 6, Line 23: | Insert between the words "held" and "by" the word "level" |

Signed and Sealed this

Sixteenth Day of November 1976

[SEAL]

*Attest:*

RUTH C. MASON
*Attesting Officer*

C. MARSHALL DANN
*Commissioner of Patents and Trademarks*